US011725462B1

(12) United States Patent
Tchakarov

(10) Patent No.: US 11,725,462 B1
(45) Date of Patent: Aug. 15, 2023

(54) ELECTRICAL WET CONNECTION BETWEEN LWD/MWD TOOLS WITH LONGITUDINAL AND ROTATIONAL DEGREE OF FREEDOM AND PRESSURE PROTECTION ELIMINATING VIBRATION AND SHOCK EFFECTS

(71) Applicant: Well Resolutions Technology, Houston, TX (US)

(72) Inventor: Borislav J. Tchakarov, Houston, TX (US)

(73) Assignee: Well Resolutions Technology, Houston, TX (US)

( * ) Notice: Subject to any disclaimer, the term of this patent is extended or adjusted under 35 U.S.C. 154(b) by 0 days.

(21) Appl. No.: 17/963,643

(22) Filed: Oct. 11, 2022

Related U.S. Application Data

(60) Provisional application No. 63/408,367, filed on Sep. 20, 2022.

(51) Int. Cl.
*E21B 17/02* (2006.01)

(52) U.S. Cl.
CPC ..... *E21B 17/028* (2013.01); *E21B 17/023* (2013.01)

(58) Field of Classification Search
CPC ..... E21B 17/028; E21B 17/023; E21B 23/00; E21B 41/00
See application file for complete search history.

(56) References Cited

U.S. PATENT DOCUMENTS

2008/0078556 A1* 4/2008 Stoesz ..... E21B 17/023 166/385
2010/0300698 A1* 12/2010 Bedouet ..... E21B 17/07 73/152.46
2014/0352793 A1* 12/2014 Martin ..... F16L 37/35 137/14
2019/0309621 A1* 10/2019 Kaur ..... E21B 4/02

* cited by examiner

*Primary Examiner* — Brad Harcourt
(74) *Attorney, Agent, or Firm* — Hunton Andrews Kurth LLP

(57) ABSTRACT

Electrical wet connection (EWC) with multiple power and communication lines for connecting Logging While Drilling tools (LWD) and/or Measurement While Drilling tools (MWD) is described. The contacts between the modules may be made by, for example, using pressure bulkheads to ensure protection of the tools if the pressure protection is reduced or lost. The contacts may be locked together in a convenient manner to eliminate downhole vibrations and/or shocks. The may make the signal transmission quality approaching, as good as, or even better than wireline tools. The connection may be sealed from the well muds under high pressure and this protection may be enhanced such as by doubling or even tripling for extreme reliability in difficult environments. The designs described herein may advantageously allow for a large amount in collar lengths to be compensated and/or provide two degrees of freedom-rotational and/or may be longitudinal for ready connection on the well site.

20 Claims, 5 Drawing Sheets

Lower Bottom Connection

Upper (Top) Connection

ELECTRICAL WET CONNECTION BETWEEN LWD/MWD TOOLS WITH LONGITUDINAL AND ROTATIONAL DEGREE OF FREEDOM AND PRESSURE PROTECTION ELIMINATING VIBRATION AND SHOCK EFFECTS

CROSS-REFERENCE TO RELATED APPLICATIONS

The present application claims priority to U.S. Provisional Application No. 63/408,367 filed Sep. 20, 2022 which application is incorporated herein by reference.

FIELD OF THE DISCLOSURE

The present disclosure relates to improved tools related to logging while drilling (LWD) and measurement while drilling (MWD).

BACKGROUND AND SUMMARY

Prior art systems are fraught with deficiencies. For example, Wallace U.S. Pat. No. 7,074,064 "ELECTRICAL CONNECTOR USEFUL IN WET ENVIRONMENTS" dated Jul. 11, 2006 has a very complicated design with multiple spring loaded parts to keep the contacts engaged in downhole conditions. The longitudinal vibrations and shock accelerations can reach hundreds g with spikes above 1000 g. The quality of electrical connections in such conditions is critical and presents problems if not correct. Wallace's system unfortunately requires very close length matching of the collars on both the male and the female side of the connection.

Li et al. U.S. Pat. No. 9,466,916 "MULTI-CONTACT CONNECTOR ASSEMBLY" dated Oct. 11, 2016 is also problematic as its rotatable connector still has to be spring loaded to compensate for the spikes in vibration and shock. And, like Wallace, Li's length matching has to be very close.

Christiansen et al. U.S. Pat. No. 9,270,051 "WET MATE CONNECTOR" dated Feb. 23, 2016 shows yet another spring loaded rotatable connector having the same operational issues while Deere et al. U.S. Pat. No. 9,322,234 dated Apr. 26, 2016 is not applicable for LWD tools and collars.

What is needed are improved methods and systems for connecting LWD and MWD tools. Advantageously, the presently described systems and methods solve one or more of the aforementioned issues and have additional advantages.

In one embodiment the application pertains to a protection system for electrical wet connectors such as those used in connected LWD and/or MWD and other measurement and downhole tools. The protection system comprises a spring loaded cable operably connecting an upper assembly and a lower assembly.

The upper assembly comprises an upper module enclosing an upper module internal electronics space. The upper module comprises an upper module first pressure bulkhead extending from the upper module and mated to an upper module second pressure bulkhead. The upper module second pressure bulkhead is attached to a first end of the spring loaded cable.

The lower assembly comprises a lower module enclosing a lower module internal electronics space. The lower module comprises a lower module first pressure bulkhead extending from the lower module and mated to a lower module second pressure bulkhead. The lower module second pressure bulkhead is attached to a second end of the spring loaded cable.

A pressure housing may be attached to the upper assembly, the lower assembly or both. The pressure housing is configured to encapsulate the spring loaded cable, the upper module first pressure bulkhead mated to the upper module second pressure bulkhead, and the lower module first pressure bulkhead mated to the lower module second pressure bulkhead.

These and other objects, features and advantages of the exemplary embodiments of the present disclosure will become apparent upon reading the following detailed description of the exemplary embodiments of the present disclosure, when taken in conjunction with the appended claims.

BRIEF DESCRIPTION OF THE DRAWINGS

Various embodiments of the present disclosure, together with further objects and advantages, may best be understood by reference to the following description taken in conjunction with the accompanying drawings.

DETAILED DESCRIPTION

The following description of embodiments provides a non-limiting representative examples referencing numerals to particularly describe features and teachings of different aspects of the invention. The embodiments described should be recognized as capable of implementation separately, or in combination, with other embodiments from the description of the embodiments. A person of ordinary skill in the art reviewing the description of embodiments should be able to learn and understand the different described aspects of the invention. The description of embodiments should facilitate understanding of the invention to such an extent that other implementations, not specifically covered but within the knowledge of a person of skill in the art having read the description of embodiments, would be understood to be consistent with an application of the invention.

The electrical wet connection protection systems described herein may include one or more of the following features:

- Upper and lower contacts assemblies may be connected with spring loaded cable isolated from the well bore pressure with pressure housing; and/or
- The pressure housing may be torqued on one end to one of the modules being connected and configured to slide over the second module for longitudinal degree of freedom and it can rotates at the same time for rotational degree of freedom; and/or
- The pressure housing may be double or triple sealed for extreme pressure protection; and/or Both upper and lower contact assemblies may be made using male and female pressure bulkheads for extra protection layers; and/or The male and female bulkheads may be torqued together for eliminating the effects of downhole vibrations and shocks while drilling; and/or The spring loaded cable connecting the upper and lower pressure bulkheads may be molded with a high pressure, high temperature mold to substantially prevent well bore fluids from reaching the electrical contacts on the back of the upper and lower pressure bulkheads; and/or Double pressure protection of the female bulkheads to the male bulkheads for electrical isolation offer additional protection in case the outside pressure protection fails;

Double pressure protection of the female bulkheads may help isolate the atmospheric electronics and measurement space of the upper and lower modules (LWD, MWD, or other tools); and/or Double pressure protection (sealing) of the torqued end of the pressure housing may assist in isolating the EWC; and/or A sliding pressure housing may allow for a higher range of length deviation to match between the LWD, MWD, or other collars being connected.

Figure 1:
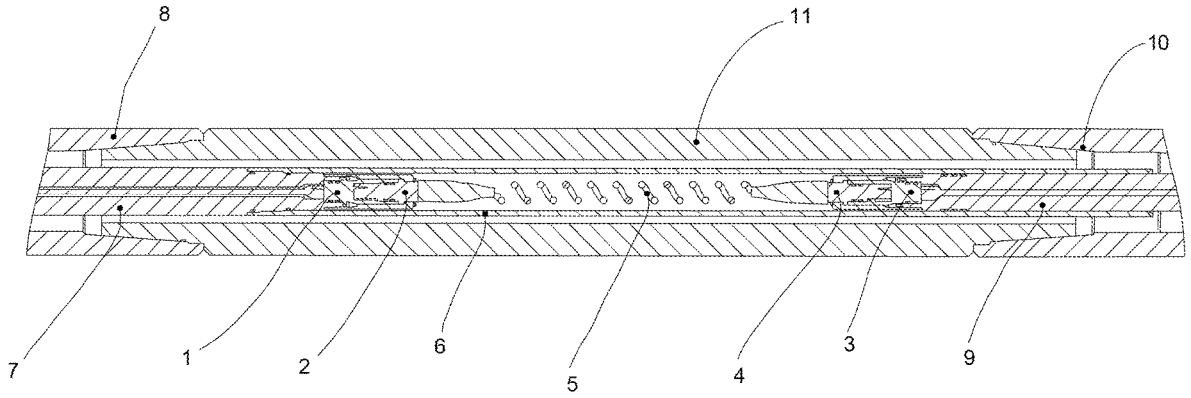
FIG. 1 shows a cross section view of a fully assembled Electrical Wet Connection (EWC) between Upper LWD/MWD collar 8 and Lower LWD/MWD collar 10.

FIG. 1 is a cross section of a representative fully assembled Electrical Wet Connection (EWC) protection system between upper LWD/MWD collar 8 and lower LWD/MWD collar 10. This EWC assembly may include a cross over collar sub 11. The upper LWD/MWD module 7 holds Male pressure bulkhead 1 and the Lower LWD/MWD module 9 holds Male pressure bulkhead 3. They are connected with spring loaded cable 5 with Upper female bulkhead 2 engaging 1 and Lower female pressure bulkhead 4 engaging 3. The Cable 5 and the Upper and Lower connection are covered with Pressure housing 6 which is screwed into the Upper LWD/MWD module 7 and slides over the Lower LWD/MWD module 9.

Figure 2:
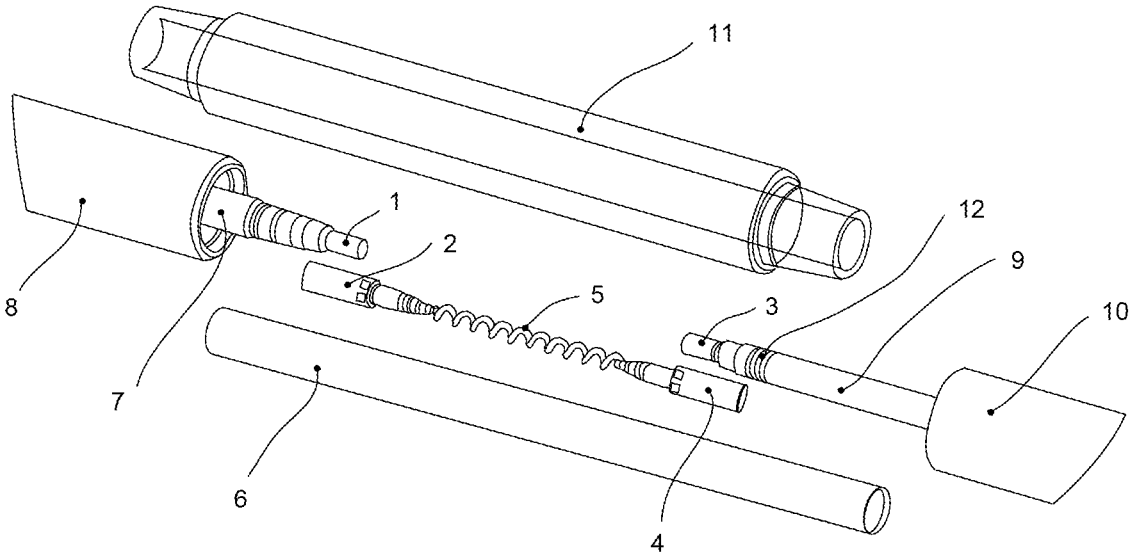
FIG. 2 shows is a blown up three dimensional assembly of the EWC.
Figure 3:
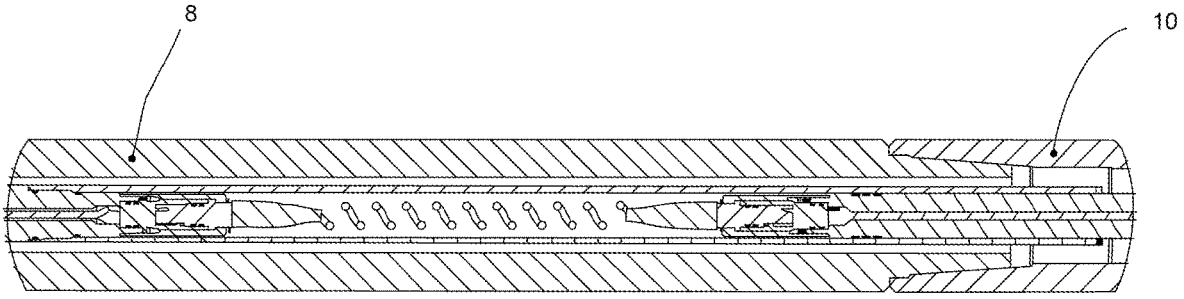
FIG. 3 shows an assembly view of a fully assembled Electrical Wet Connection (EWC) between Upper LWD/MWD collar 8 and Lower LWD/MWD collar 10.

FIG. 2 is a blown up 3D assembly drawing of the EWC. FIG. 3 is a direct assembly between Upper LWD/MWD collar 8 and Lower LWD/MWD collar 10. Such an assembly may be accomplished prior to the shipping to the rig site as an assembled unit or alternatively assembled at the rig site. Assembly at the rig site may be more readily accomplished when, for example, the length of 8 and 10 is well matched.

Figure 4:
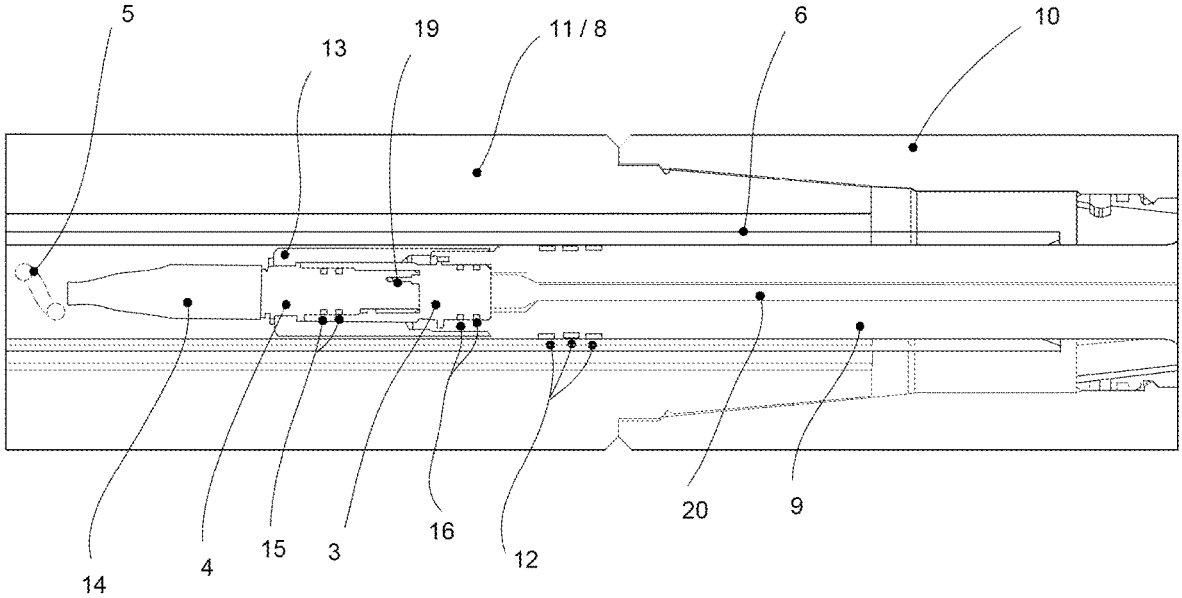
FIG. 4 shows a close cross section view of the Lower EWC assembly and illustrates multiple pressure protection of the EWC.

FIG. 4 is a close cross-sectional view of the lower EWC assembly and illustrates the multiple pressure protections of the EWC that may be included depending upon the environment in which it will be used. As shown, the pressure housing 6 may be configured to slide over the Lower LWD/MWD module 9. The inside may be pressure sealed with a convenient seal such as, by for example, using one or more O-rings such as triple O-ring seals 12. While rotational and longitudinal freedom to make the assembly of EWC may be provided in any convenient such as, for example, the sliding engagement exemplified in FIG. 4. The spring loaded cable 5 may be connected to the female bulkhead in a convenient manner such as by molding to the female bulkhead 4 with mold 14 in FIG. 4.

Advantageously, many redundancies may be included in the system depending upon the environment to which the EWC will be exposed. For example, if the primary pressure protection of EWC may be compromised, then pressure housing 6 and/or the seals 12 may be included. Further, if there is concern about the potentially failure of pressure housing 6 and/or the seals 12, then mold 14 may be included as secondary protection of the EWC so that the quality of the electrical connection will not be compromised. If included, the mold 14 may be configured and/or designed of a material such that mold 14 may hold the maximum operating pressure and temperature without allowing conductive and/or erosive drilling mud coming in contact with the electrical contacts such as those on the end of 4. Further, if there is a concern about 6 and 12 failing such that the interior may fill with drilling mud under pressure, the electrical contacts 19 may be isolated with a seal such as one or more O-rings such as the double O-rings 15. Similarly, the internal electronics and measurement atmospheric space 20 inside the lower LWD/MWD module 9 and/or the upper LWD/MWD module 7 may also be sealed with one or more O-rings such as, for example, double O-rings 16. The bulheads may be connected in any convenient manner so long the desired connection is maintained at the shock and vibration conditions expected. For example, in FIG. 4 male bulkhead 3 and female bulkhead 4 are torqued together with a locking housing 13 screwed into 9. This may advantageously provide atmospheric wireline quality connection immune to shock and vibration.

Figure 5:
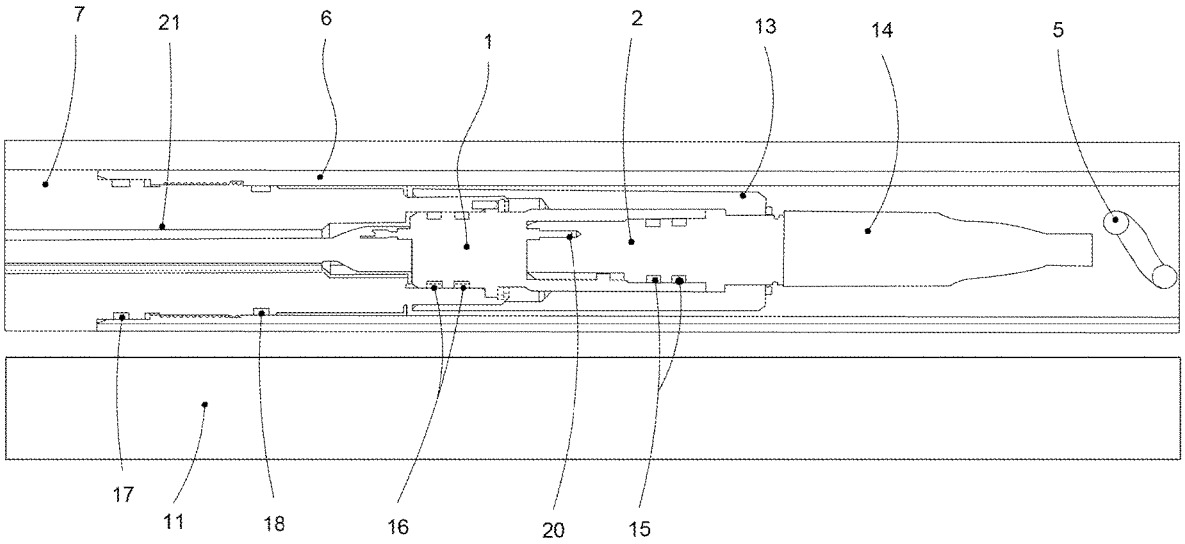
FIG. 5 shows a close cross section view of the Upper EWC assembly and illustrates multiple pressure protection of the EWC.

FIG. 5 is a close cross-section view of the upper EWC connection and illustrates the multiple pressure protections that may be included in the system. It is a mirror image of the lower EWC except the top of the pressure housing 6 may be screwed into the Upper LWD/MWD module 7. The thread may be sealed with, for example, O-rings 17 and 18 to isolate the inside of the EWC. The Cable 5 may have identical ends or alternatively may include a designated upper 2 and/or lower 4 female bulkhead.

The components of FIGS. 1-5 and the materials that may be employed are in the Table below. One of skill in the art will recognize

| Component | Exemplary Materials Depending Upon Environment |
|---|---|
| Upper Collar 8 and Lower Collar 10 | Non-magnetic alloys such as those meeting API spec. 7.1, e.g., P550 austenitic Mn-Cr-steel with a high nitrogen content |
| Cross-Over Collar Sub 11 | Non-magnetic alloys such as those meeting API spec. 7.1, e.g., P550 austenitic Mn-Cr-steel with a high nitrogen content |
| Upper Module 7 and Lower Module 9 | Non-magnetic high strength material such as INCONEL materials like INCONEL 718 which is a high-strength, corrosion-resistant nickel chromium material |
| Male Pressure Bulkheads 1 and 3 | High strength alloy which may include a glass to metal seal for the contacts |
| Female Pressure Bulkheads 2 and 4 | High strength alloy which may include a glass to metal seal for the contacts |
| Pressure Housing 6 | High strength alloys such as, for example, BeCu and nitrogen-strengthened stainless steel alloys like NITRONIC |
| Spring Loaded Cable 5 | Shielded isolated copper wires (Spring Loaded) |
| O-ring seals 12, 15, 16, 17 and 18 | Corrosion-resistant elastomers and/or synthetic rubbers such as fluoroelastomers like VITON ™ |
| Mold 14 | Corrosion-resistant elastomers and/or synthetic rubbers such as fluoroelastomers like VITON ™ |
| Locking Housing 13 | High strength alloys |
| Electrical Contacts 19 | Conductive metals such as gold plated metal contacts |

Advantages of the embodiments described in the present application may include one or more up to all of the following:

(1) a simple and reliable assembly relatively immune to shock and vibration;

(2) allows for higher collar length deviation in LWD and/or MWD collars;

(3) allows for isolation of electrical contacts from shock and/or vibration with high quality signal transfer that may be as good as or even better than wireline connection quality of the signal transfer;

(4) may include multiple pressure protections; and/or (5) may provide rotational and/or sliding/longitudinal freedoms between one or more upper sections and one or more lower sections of the EWC.

SPECIFIC EMBODIMENTS

1. An electrical wet connection system for downhole tools wherein the system comprises:
   a spring loaded cable operably connecting an upper assembly and a lower assembly; wherein the upper assembly comprises:
      an upper module enclosing an upper module internal electronics space, wherein the upper module comprises a male upper module first pressure bulkhead extending from the upper module and mated to a female upper module second pressure bulkhead with a locking housing and wherein the female upper module second pressure bulkhead is attached to a first end of the spring loaded cable; and
   wherein the lower assembly comprises:
      a lower module enclosing a lower module internal electronics space, wherein the lower module comprises a male lower module first pressure bulkhead extending from the lower module and mated to a female lower module second pressure bulkhead with a locking housing and wherein the female lower module second pressure bulkhead is attached to a second end of the spring loaded cable;
   a pressure housing screwed into the upper module, wherein the pressure housing is configured to slide over the lower module and encapsulate the lower module, the spring loaded cable, the male upper module first pressure bulkhead mated to the female upper module second pressure bulkhead, and the female lower module first pressure bulkhead mated to the lower module second pressure bulkhead;
   one or more seals surround a component of the lower assembly and abut the pressure housing; and
   one or more seals surround a component of the upper assembly and abut the pressure housing.
2. The system of any preceding embodiment wherein the female upper module second pressure bulkhead and the female lower module second pressure bulkhead each comprise one or more electrical contacts.
3. The system of any preceding embodiment wherein the one or more electrical contacts are isolated with one or more O-rings.
4. The system of any preceding embodiment wherein the one or more seals comprise one or more O-rings abutting the pressure housing and surrounding one or more up to all of the male lower module first pressure bulkhead, the female lower module second pressure bulkhead, the male upper module first pressure bulkhead, and the female upper module second pressure bulkhead.
5. The system of any preceding embodiment which further comprises a covering comprising an upper collar, a lower collar, and a cross-over collar sub threadedly connected to the upper collar and the lower collar.
6. An electrical wet connection system for downhole tools wherein the system comprises:
   a spring loaded cable operably connecting an upper assembly and a lower assembly;
   wherein the upper assembly comprises:
      an upper module enclosing an upper module internal electronics space, wherein the upper module comprises an upper module first pressure bulkhead extending from the upper module and mated to an upper module second pressure bulkhead and wherein the upper module second pressure bulkhead is attached to a first end of the spring loaded cable; and
   wherein the lower assembly comprises:
      a lower module enclosing a lower module internal electronics space, wherein the lower module comprises a lower module first pressure bulkhead extending from the lower module and mated to a lower module second pressure bulkhead and wherein the lower module second pressure bulkhead is attached to a second end of the spring loaded cable; and
   a pressure housing attached to the upper assembly, lower assembly or both; wherein the pressure housing is configured to encapsulate the spring loaded cable, the upper module first pressure bulkhead mated to the upper module second pressure bulkhead, and the lower module first pressure bulkhead mated to the lower module second pressure bulkhead.
7. The system of any preceding embodiment wherein the pressure housing is configured to screw into the upper module and slide over the lower module for longitudinal degree of freedom.
8. The system of any preceding embodiment wherein the upper module first pressure bulkhead, upper module second pressure bulkhead, or both comprise electrical contacts.
9. The system of any preceding embodiment wherein the lower module first pressure bulkhead, lower module second pressure bulkhead, or both comprise electrical contacts.
10. The system of any preceding embodiment wherein the lower module first pressure bulkhead, lower module second pressure bulkhead, or both comprise electrical contacts isolated with one or more O-rings.
11. The system of any preceding embodiment wherein the lower module is sealed with one or more O-ring seals surrounding the lower module and abutting the pressure housing.
12. The system of any preceding embodiment wherein the upper module is sealed with one or more O-ring seals surrounding the upper module and abutting the pressure housing.
13. The system of any preceding embodiment wherein the upper module first pressure bulkhead extending from the upper module is a male upper module first pressure bulkhead and wherein the upper module second pressure bulkhead is a female upper module second pressure bulkhead.
14. The system of any preceding embodiment wherein the lower module first pressure bulkhead extending from the lower module is a male lower module first pressure bulkhead and wherein the lower module second pressure bulkhead is a female lower module second pressure bulkhead.
15. The system of any preceding embodiment which further comprises a covering comprising an upper collar, a lower collar, and a cross-over collar sub threadedly connected to the upper collar and the lower collar.
16. The system of any preceding embodiment wherein the lower module internal electronics space comprises an MWD tool.

17. The system of any preceding embodiment wherein the upper module internal electronics space comprises an MWD tool.
18. The system of any preceding embodiment wherein the lower module internal electronics space comprises an LWD tool.
19. The system of any preceding embodiment wherein the upper module internal electronics space comprises an LWD tool.
20. An electrical wet connection system for downhole tools wherein the system comprises:
a spring loaded cable operably connecting an upper assembly and a lower assembly;
wherein the upper assembly comprises:
an upper module enclosing an upper module internal electronics space, wherein the upper module comprises a male upper module first pressure bulkhead extending from the upper module and mated to a female upper module second pressure bulkhead with a locking housing and wherein the female upper module second pressure bulkhead is attached to a first end of the spring loaded cable; and
wherein the lower assembly comprises:
a lower module enclosing a lower module internal electronics space, wherein the lower module comprises a male lower module first pressure bulkhead extending from the lower module and mated to a female lower module second pressure bulkhead with a locking housing and wherein the female lower module second pressure bulkhead is attached to a second end of the spring loaded cable;
a pressure housing screwed into the upper module, wherein the pressure housing is configured to slide over the lower module and encapsulate the lower module, the spring loaded cable, the male upper module first pressure bulkhead mated to the female upper module second pressure bulkhead, and the female lower module first pressure bulkhead mated to the lower module second pressure bulkhead;
at least one O-ring seal abuts the pressure housing and surrounds each of the male lower module first pressure bulkhead, the female lower module second pressure bulkhead, the male upper module first pressure bulkhead, and the female upper module second pressure bulkhead;
wherein the female upper module second pressure bulkhead and the female lower module second pressure bulkhead each comprise one or more electrical contacts isolated with one or more O-rings; and
a covering surrounding the upper assembly, lower assembly, and pressure housing wherein the covering comprises an upper collar, a lower collar, and a cross-over collar sub threadedly connected to the upper collar and the lower collar.

I claim:

1. An electrical wet connection system for downhole tools wherein the system comprises:
a spring loaded cable operably connecting an upper assembly and a lower assembly;
wherein the upper assembly comprises:
an upper module enclosing an upper module internal electronics space, wherein the upper module comprises a male upper module first pressure bulkhead extending from the upper module and mated to a female upper module second pressure bulkhead with a locking housing and wherein the female upper module second pressure bulkhead is attached to a first end of the spring loaded cable; and
wherein the lower assembly comprises:
a lower module enclosing a lower module internal electronics space, wherein the lower module comprises a male lower module first pressure bulkhead extending from the lower module and mated to a female lower module second pressure bulkhead with a locking housing and wherein the female lower module second pressure bulkhead is attached to a second end of the spring loaded cable;
a pressure housing screwed into the upper module, wherein the pressure housing is configured to slide over the lower module and encapsulate the lower module, the spring loaded cable, the male upper module first pressure bulkhead mated to the female upper module second pressure bulkhead, and the female lower module first pressure bulkhead mated to the lower module second pressure bulkhead;
one or more seals surround a component of the lower assembly and abut the pressure housing; and
one or more seals surround a component of the upper assembly and abut the pressure housing.

2. The system of claim 1 wherein the female upper module second pressure bulkhead and the female lower module second pressure bulkhead each comprise one or more electrical contacts.

3. The system of claim 2 wherein the one or more electrical contacts are isolated with one or more O-rings.

4. The system of claim 1 wherein the one or more seals comprise one or more O-rings abutting the pressure housing and surrounding one or more up to all of the male lower module first pressure bulkhead, the female lower module second pressure bulkhead, the male upper module first pressure bulkhead, and the female upper module second pressure bulkhead.

5. The system of claim 1 which further comprises a covering comprising an upper collar, a lower collar, and a cross-over collar sub threadedly connected to the upper collar and the lower collar.

6. An electrical wet connection system for downhole tools wherein the system comprises:
a spring loaded cable operably connecting an upper assembly and a lower assembly;
wherein the upper assembly comprises:
an upper module enclosing an upper module internal electronics space, wherein the upper module comprises an upper module first pressure bulkhead extending from the upper module and mated to an upper module second pressure bulkhead and wherein the upper module second pressure bulkhead is attached to a first end of the spring loaded cable; and
wherein the lower assembly comprises:
a lower module enclosing a lower module internal electronics space, wherein the lower module comprises a lower module first pressure bulkhead extending from the lower module and mated to a lower module second pressure bulkhead and wherein the lower module second pressure bulkhead is attached to a second end of the spring loaded cable; and
a pressure housing attached to the upper assembly, lower assembly or both; wherein the pressure housing is configured to encapsulate the spring loaded cable, the upper module first pressure bulkhead mated to the upper module second pressure bulkhead, and the lower module first pressure bulkhead mated to the lower module second pressure bulkhead.

7. The system of claim 6 wherein the pressure housing is configured to screw into the upper module and slide over the lower module for longitudinal degree of freedom .

8. The system of claim 6 wherein the upper module first pressure bulkhead, upper module second pressure bulkhead, or both comprise electrical contacts.

9. The system of claim 6 wherein the lower module first pressure bulkhead, lower module second pressure bulkhead, or both comprise electrical contacts.

10. The system of claim 6 wherein the lower module first pressure bulkhead, lower module second pressure bulkhead, or both comprise electrical contacts isolated with one or more O-rings.

11. The system of claim 6 wherein the lower module is sealed with one or more O-ring seals surrounding the lower module and abutting the pressure housing.

12. The system of claim 6 wherein the upper module is sealed with one or more O-ring seals surrounding the upper module and abutting the pressure housing.

13. The system of claim 6 wherein the upper module first pressure bulkhead extending from the upper module is a male upper module first pressure bulkhead and wherein the upper module second pressure bulkhead is a female upper module second pressure bulkhead.

14. The system of claim 6 wherein the lower module first pressure bulkhead extending from the lower module is a male lower module first pressure bulkhead and wherein the lower module second pressure bulkhead is a female lower module second pressure bulkhead.

15. The system of claim 6 which further comprises a covering comprising an upper collar, a lower collar, and a cross-over collar sub threadedly connected to the upper collar and the lower collar.

16. The system of claim 6 wherein the lower module internal electronics space comprises an MWD tool.

17. The system of claim 6 wherein the upper module internal electronics space comprises an MWD tool.

18. The system of claim 6 wherein the lower module internal electronics space comprises an LWD tool.

19. The system of claim 6 wherein the upper module internal electronics space comprises an LWD tool.

20. An electrical wet connection system for downhole tools wherein the system comprises:

a spring loaded cable operably connecting an upper assembly and a lower assembly;

wherein the upper assembly comprises:

an upper module enclosing an upper module internal electronics space, wherein the upper module comprises a male upper module first pressure bulkhead extending from the upper module and mated to a female upper module second pressure bulkhead with a locking housing and wherein the female upper module second pressure bulkhead is attached to a first end of the spring loaded cable; and wherein the lower assembly comprises:

a lower module enclosing a lower module internal electronics space, wherein the lower module comprises a male lower module first pressure bulkhead extending from the lower module and mated to a female lower module second pressure bulkhead with a locking housing and wherein the female lower module second pressure bulkhead is attached to a second end of the spring loaded cable;

a pressure housing screwed into the upper module, wherein the pressure housing is configured to slide over the lower module and encapsulate the lower module, the spring loaded cable, the male upper module first pressure bulkhead mated to the female upper module second pressure bulkhead, and the female lower module first pressure bulkhead mated to the lower module second pressure bulkhead;

at least one O-ring seal abuts the pressure housing and surrounds each of the male lower module first pressure bulkhead, the female lower module second pressure bulkhead, the male upper module first pressure bulkhead, and the female upper module second pressure bulkhead;

wherein the female upper module second pressure bulkhead and the female lower module second pressure bulkhead each comprise one or more electrical contacts isolated with one or more O-rings; and a covering surrounds the upper assembly, lower assembly, and pressure housing wherein the covering comprises an upper collar, a lower collar, and a cross-over collar sub threadedly connected to the upper collar and the lower collar.

* * * * *